US005913508A

United States Patent [19]

Eades

[11] Patent Number: 5,913,508

[45] Date of Patent: Jun. 22, 1999

[54] MULTIPURPOSE REUSABLE SAFETY RAIL ASSEMBLY

[75] Inventor: Richard Eades, Austin, Tex.

[73] Assignee: Sure Step Gaurdrail Assembly, L. P., Austin, Tex.

[21] Appl. No.: 08/939,388

[22] Filed: Sep. 29, 1997

[51] Int. Cl.[6] ..... E04H 17/14

[52] U.S. Cl. ..... 256/65; 256/59; 256/67; 211/208

[58] Field of Search ..... 256/59, 65, 24, 256/26, 22, 19, 67; 211/208, 191

[56] References Cited

U.S. PATENT DOCUMENTS

| | | | |
|---|---|---|---|
| 2,427,723 | 9/1947 | Hawkins et al. | 256/22 |
| 2,835,475 | 5/1958 | Enghauser | 256/22 |
| 2,870,996 | 1/1959 | Helt | 256/65 X |
| 2,976,021 | 3/1961 | Stefan . | |
| 3,256,658 | 6/1966 | Seery . | |
| 3,266,635 | 8/1966 | McConnell | 211/191 |
| 3,648,982 | 3/1972 | Sabel et al. . | |
| 3,756,568 | 9/1973 | Mocny et al. . | |
| 3,776,521 | 12/1973 | Weinert | 256/59 X |
| 3,848,854 | 11/1974 | De Barbieri . | |
| 3,880,405 | 4/1975 | Brueske . | |
| 4,006,564 | 2/1977 | Wiese . | |
| 4,030,255 | 6/1977 | Hartman | 256/59 X |
| 4,074,812 | 2/1978 | Skubic et al. | 211/208 X |
| 4,104,000 | 8/1978 | Fleischmann . | |
| 4,195,385 | 4/1980 | Cole . | |
| 4,423,817 | 1/1984 | Monjo-Rufi | 211/191 X |
| 5,188,342 | 2/1993 | Quellette et al. | 256/59 X |
| 5,238,321 | 8/1993 | Jarjoura | 256/65 X |
| 5,452,880 | 9/1995 | Bailey | 256/26 X |
| 5,456,451 | 10/1995 | Eyler, Jr. . | |
| 5,527,016 | 6/1996 | Wilkerson, Jr. . | |
| 5,547,169 | 8/1996 | Russell . | |
| 5,560,588 | 10/1996 | Hilliard | 256/59 X |
| 5,624,045 | 4/1997 | Highsmith et al. | 211/191 X |
| 5,795,503 | 8/1998 | Krake | 256/65 |

*Primary Examiner*—Harry C. Kim
*Attorney, Agent, or Firm*—Joseph F. Long

[57] ABSTRACT

A group of posts, rails, right and left side L shaped post to rail connectors, base plates, and toeboard holding plates to allow temporary or permanent installation of a safety guard rail system with two or more guard rails that may be used as a guard rail on stairways or on flat surfaces. Installation may be by one man using only tools necessary to fasten base plates to a surface. The same group of parts can be used to form rectangular, square, or odd shaped scaffolds with or without toe board holders.

8 Claims, 4 Drawing Sheets

MULTIPURPOSE REUSABLE SAFETY RAIL ASSEMBLY

BACKGROUND OF THE INVENTION

There is a need for a reusable easily assembable safety guard rail that is sufficiently rigid to meet or exceed OSHA regulations as well as a need for simple reliable easily assembled scaffolding. There is a considerable body of prior art relative to safety railings. No prior art for safety railing with the simplicity of installation and assembly and disassembly and with the versatility for forming rail guards for various space shapes and inclinations or for a similar structure to form scaffolding has been found.

The invention comprises posts and railings and connectors with variable length posts and various manually removable connectors between the posts and fixed or extensible railings to allow one man to install safety railings or simple scaffolds. The posts have a C shaped cross section and would be about four inches wide and from about four to ten feet long depending upon the use. Each post has equally spaced dual slot type openings starting near each edge of the post and slanting downward toward the center of the post. There are both left and right side manually installable L shaped connector plates that are punched on one side to form projections that serve to hold the connector plate more tightly to the post when downward pressure is applied to the connector plate. A special type hinge to allow connecting the railings to the L shaped connector plate so that a railing that provides a safety railing on a stairs or that encompasses an odd shaped space may be quickly installed. Rigid projections on the L shaped connector plates allow forming rigid safety railings for normal use The same connectors allow forming or assembling scaffolds that may be square, rectangular, or differing shapes to fit a particular need.

SUMMARY OF THE INVENTION

The invention may be summarized as a group of posts, rails, right and left side L shaped connectors, base plates, and toeboard holding plates to allow temporary or permanent installation of a safety guard rail system with two or more guard rails by one man using only tools necessary to fasten base plates to a surface. The same group of parts can be used to form rectangular, square, or odd shaped scaffolds.

The posts all have a C shaped cross section and all have downward slanted openings starting on each edge of the longer side of the post. The manually removable and installable connector plates are L shaped with each side being about four iches by two inches with one side having dual inwardly punched projections to slide into the slanted openings on each side of the posts. Increased downward pressure on the connector plate causes the connector plate to be pulled more tightly against the post. The rails, which are normally extensible, are fastened between posts using the connector plates with suitable projections welded or fastened thereto. Connector plates may have suitable hinges to connect with the rails to allow rails to be moved vertically or horizontally and these may be used to assemble temporary guard rails for winding stairways. Other connector plates have rigid projections welded thereto at angles to allow assembly of rigid guard rails or scaffolds or for rigid guard rails on straight stairways with a known angle. Still other connector plates may have small plates welded thereto to allow the connector to hold toeplates along a floor or just above scaffold boards.

DESCRIPTION OF THE INVENTION

Figure 1:
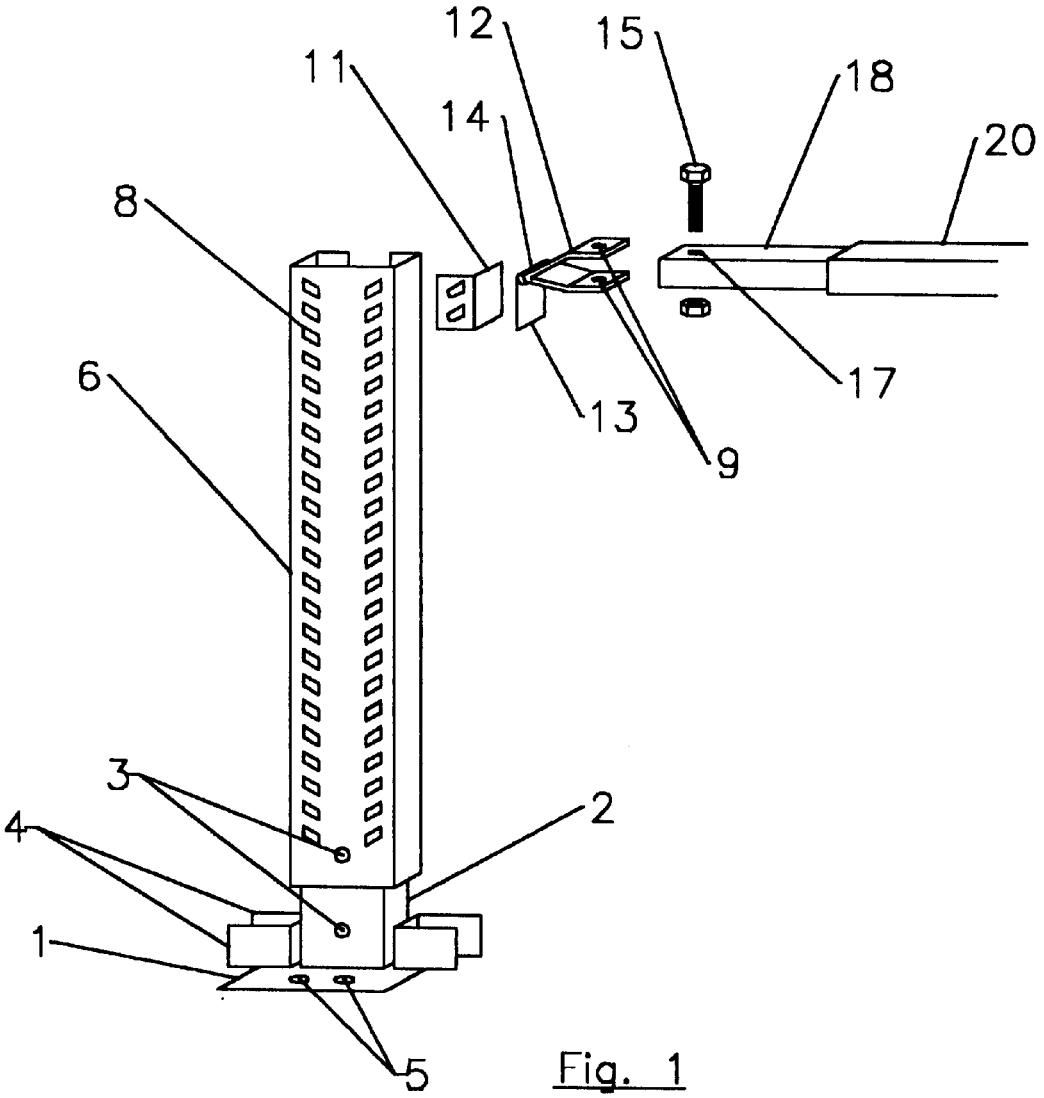
FIG. 1 shows an exploded view of connections to a support post.
Figure 8:
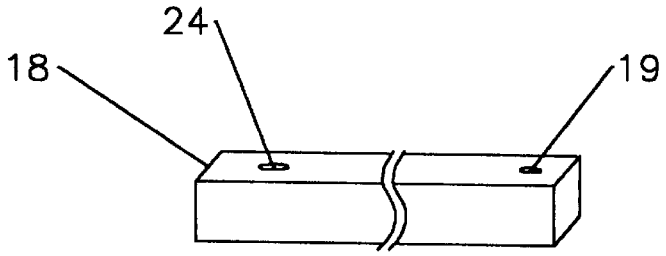
FIG. 8 shows an inner telescoping rail.
Figure 9:
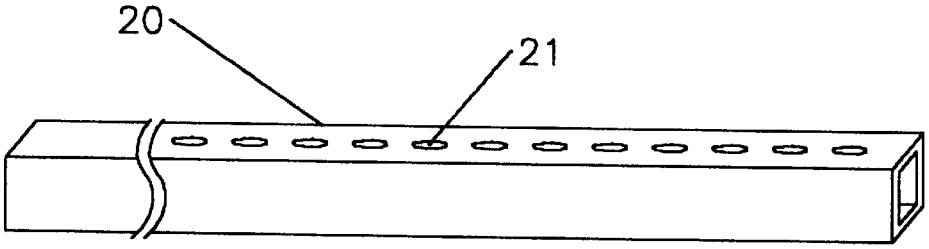
FIG. 9 shows an outer telescoping rail.

The patent may best be described from the drawings. In FIG. 1 the C shaped post 6 with slot type openings 8 fits down snugly over post connector 2 that is affixed to base plate 1, a pin (not shown) is used through holes 3 to firmly hold the post in place. Plates 4 may be about three inches by four inches, and spaced about one and three quarters of an inch apart to allow removably holding a toeboard. The self tightening connector plate 11, shown in more detail in FIG. 4, may be slipped in place to hold tightly against post 6 after the single side of hinge 12 is welded to connector plate 11. Extensible rail 18 may be slipped into the dual side of hinge 12 until holes 9 and 17 are aligned to allow dropping pin 15 through the holes to connect inner extensible rail 18 movably to post 6. The outer extensible rail 20 may be pinned to the inner rail as shown in FIG. 8 and FIG. 9.

Figure 2:
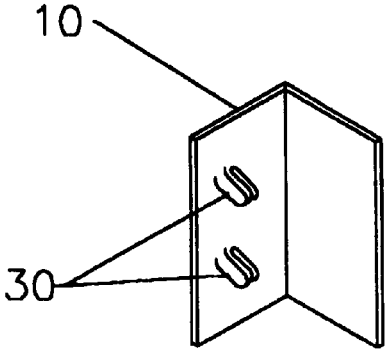
FIG. 2 shows a left side connector plate for the support post.

In FIG. 2 a left side connector plate 10 with projections punched inward and bent so that these projections 30 which are slanted opposite slots 8, FIG. 1, will pull plate 10 solidly against post 8 with slight downward pressure.

Figure 3:
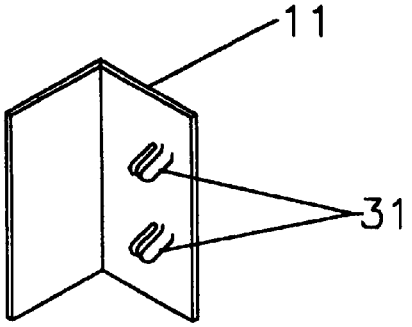
FIG. 3 shows a right side connector plate for the support post.

In FIG. 3 connector plate 11 with projections 31 similar to projections 30, FIG. 2, is a right side connector plate.

Figure 4:
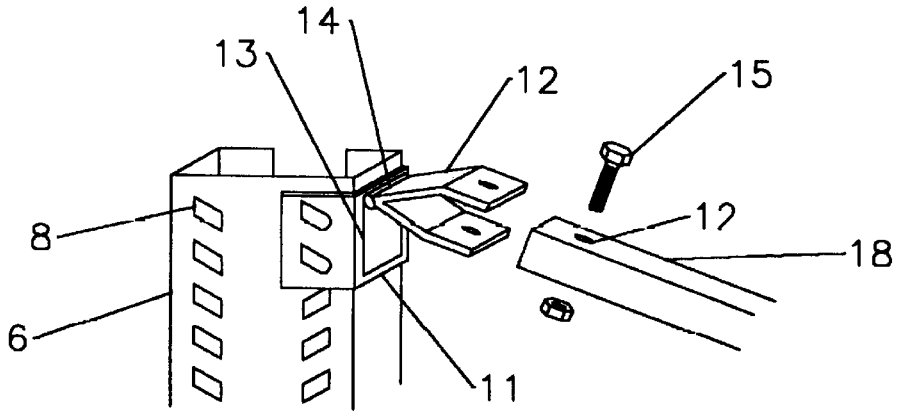
FIG. 4 shows detail of the hinged connection of an extensible rail and the support post.

FIG. 4 shows a top part of C shaped connector post with the right side connector plate 11 in place. Hinge 12 with the single side 13 welded to the connector plate 11 and the double side pivoted at 14 may be connected to rail 18 with pin 15 when the openings in hinge 12 are aligned with opening 17. This connection allows both vertical and horizontal motion of the rails 18 thereby allowing the railing system to be installed on a winding stairway as well as a horizontal surface. Other connectors allowing similar movement would be within the purview of this invention.

Figure 5:
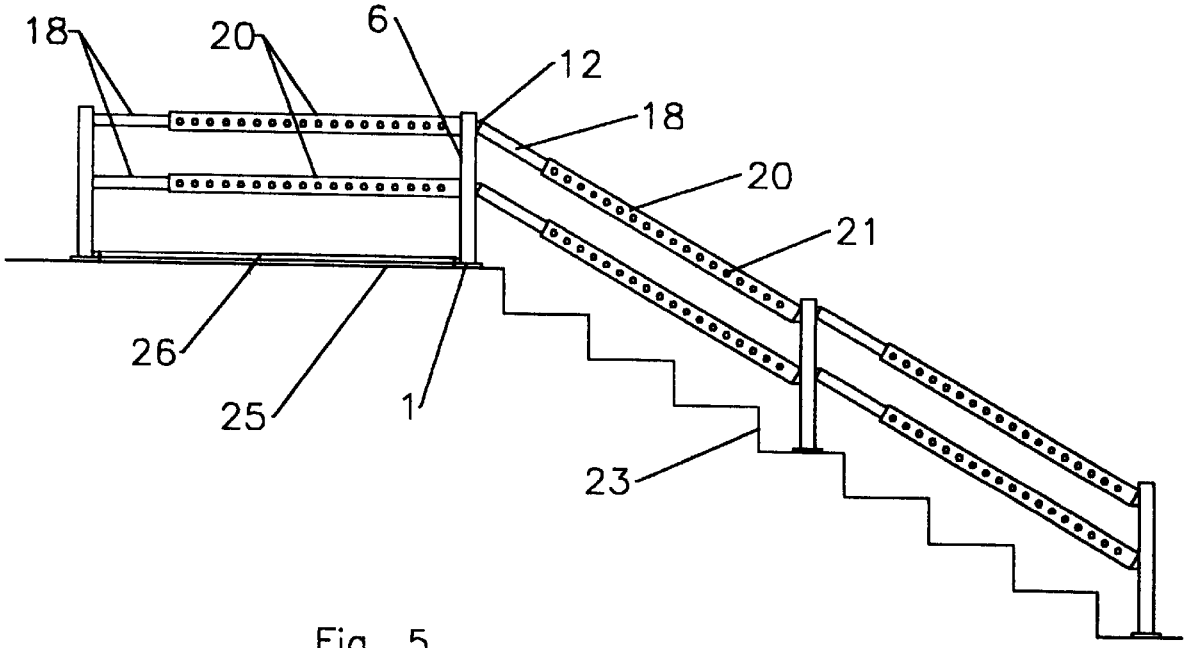
FIG. 5 shows rail assemblies used on a stairway and on a level platform.
Figure 6:
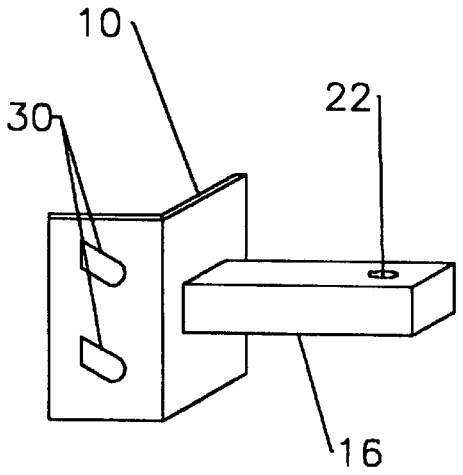
FIG. 6 shows a first right side connector plate for a rigid railing system and for a scaffold.
Figure 7:
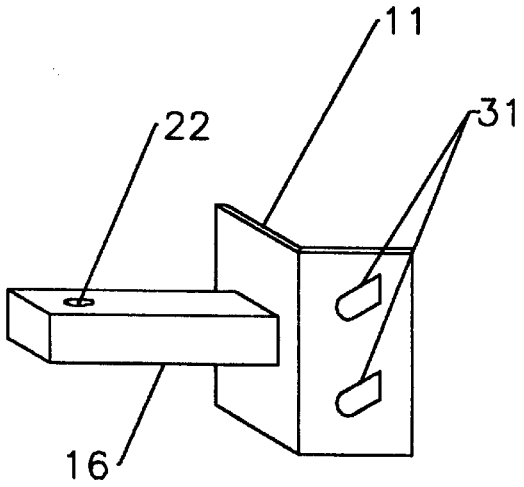
FIG. 7 shows a first left side connector plate for a rigid system.

FIG. 5 shows posts 6 with baseplate 1 as the system would be installed on stairs 23 using hinged connectors 12 on the stairway and fixed connectors, shown in detail in FIGS. 6 and 7, on the landing 25. Toeplate 26 would be used on the landing 25 but would not be used on the stairs 23. Hinges 12 allow movement to positions as shown for rails 18 and 20 with multiple openings 21, shown in detail in FIG. 8, allow pinning or otherwise connecting rails 18 and 20 at the desired length.

FIG. 6 shows rigid connector 16 with opening 22 welded at right angles to the right side post connector plate 10 with projections 30. This connector allows connecting the extensible rails 18 and 20 in a straight line with the face of post 6. Although not shown this connector 16 could be welded at an angle to allow installation of rigid railings at differing angles.

FIG. 7 shows rigid connector 16 welded to a left side post connector plate 11 with fastening projections 31.

FIG. 8 shows inner extensible rail 18 with opening 24 to allow connecting to post connector plate and opening 19 to allow pinning to an outer extensible rail 20, FIG. 9.

FIG. 9 shows an outer extensible rail 20 with multiple openings 21 that are aligned on both sides of the rail to allow pinning rail 18, FIG. 8 at differing effective lengths. Many other methods of connecting extensible rails at a desired point are possible and would be within the purview of this invention.

Figure 10:
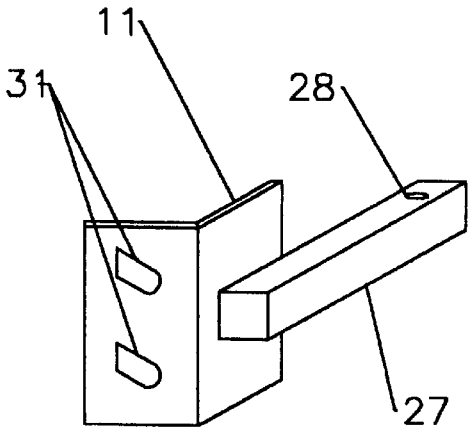
FIG. 10 shows a second connector plate to fit on the right side of the C shaped post to allow forming a right angled rigid rail system.

FIG. 10 shows rigid connector 27 with an opening 28 with the connector 28 welded to the smooth side of a right side post connector plate 11 to allow fastening rails 18 and 20, FIGS. 8 and 9 at right angles to the post face 6, FIG. 1.

Figure 11:
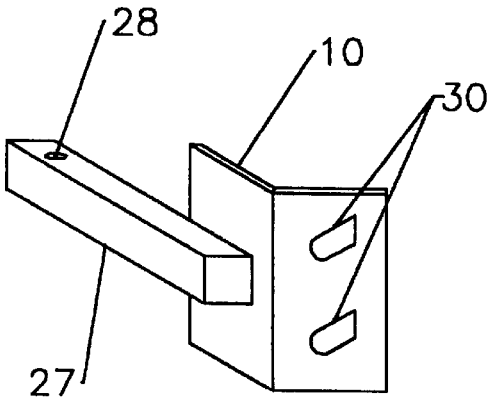
FIG. 11 shows a second connector plate to fit on the left side of the C shaped post to allow forming a right angled rigid rail system.

FIG. 11 shows connector 27 to a left side post connector plate 10 to allow fastening rails 18 and 20, FIGS. 8 and 9, at right angles to post face 6.

Figure 12:
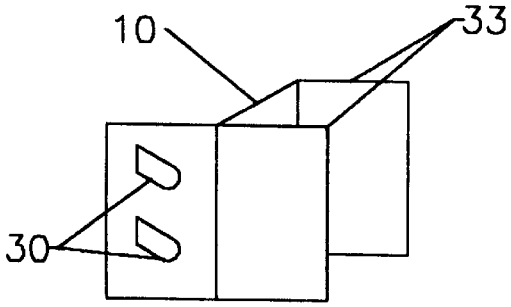
FIG. 12 shows a third connector plate to fit on a right side of the C shaped posts with toeboard holding projections attached to the connector plate.

FIG. 12 shows projections 33 which may be about three inches by four inches and one and three fourths of an inch apart welded or otherwise fastened to a right side post connector plate 10 to hold a toepiece above scaffold planks. Projections 30 removably hold post connector plate 10 to a right side of post 6, FIG. 1.

Figure 13:
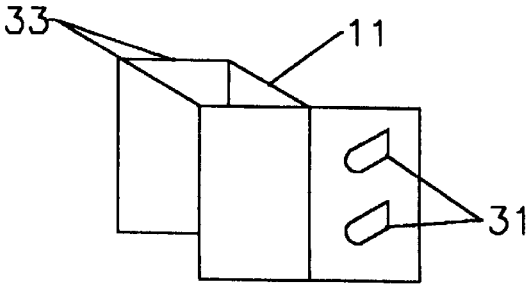
FIG. 13 shows a third connector plate to fit on a left side of the C shaped posts with toeboard projections attached to the connector plate.

FIG. 13 is similar to FIG. 12 with similar toepiece holding projections 33 attached to a left side post connector plate 11. Projections 31 removably hold connector plate 11 to a right side of post 6, FIG. 1.

What is claimed is:

1. A multipurpose reusable rail assembly comprising:

a) multiple posts with a C shaped cross section, said posts having multiple evenly spaced downward slanted openings along each edge of a longer side of said C shaped cross section;

b) right side and left side post connector plates; each of said right side and said left side post connector plates having projection means that slidably fit into a minimum of two of said multiple evenly spaced downward slanted openings in said C shaped posts with said projection means being so shaped that downward pressure on said post connector plates causes said post connector plates to pull more tightly to said posts; and c) multiple extensible rail means and multiple rail connector means; said rail connector means connecting ends of said extensible rail means to said post connector plates; said rail connector means consisting of a hinge connector that is pivotally fastenable on a single side to said post connector plate and is pivotally fastenable on a dual side to an end of said extensible rail means to allow said extensible rail means to be moved both vertically and horizontally relative to said C shaped post; said extensible rail means having a first rail that slidably fits within a second rail;

d) a fastening means to rigidly fasten together said extensible rail means at a desired effective length.

2. A multipurpose reusable rail assembly as in claim 1 further comprising:

a) baseplates, said baseplates having multiple openings to allow fastening said baseplates to a surface and each having a rigid vertical post connector to allow fastening said posts with said C shaped cross section in a vertical position.

3. A multipurpose reusable rail assembly as in claim 2 further comprising toe board holders; said toe board holders being plates mounted upright on said baseplates with one of said plates being mounted on each side of said rigid vertical post connector.

4. A multipurpose reusable rail assembly comprising:

a) multiple posts with a C shaped cross section, said posts having multiple evenly spaced downward slanted openings starting from each edge of a longer side of said C shaped cross section;

b) right side and left side post connector plates; each of said right side and said left side post connector plates having rigid projection means that slidably fit into a minimum of two of said multiple evenly spaced downward slanted openings in said C shaped posts with said projection means being so shaped that downward pressure on said post connector plates causes said post connector plates to pull more tightly to said posts; and with each of said post connector plates having a rigid rail connector means rigidly fastened at a horizontal angle of less than 181 degrees in a plane that is at a 90 degree angle to said side post connector plates;

c) multiple extensible rail means with said rigid rail connector means being rigidly fastened on one end to said side post connector plates; said rigid rail connector means being sized to slidably fit into an end of said extensible rail means and having an opening means to allow pinning said rigid rail connector means to said extensible rail means; said extensible rail means having a first rail that slidably fits within a second rail and openings in each of said rails to allow pinning said rails together at a desired effective length.

5. A multipurpose reusable rail assembly as in claim 3 further comprising:

a) a minimum of four pair of said extensible rails interconnecting four of said posts at right angles;

b) multiple planks to form a platform across two of said extensible rails; and c) said right side and said left side post connector plates with dual plates welded thereto to provide toeplate holders to hold toeplates above said multiple planks.

6. A multipurpose reusable rail assembly comprising:

a) multiple posts with a C shaped cross section, said posts having multiple evenly spaced downward slanted openings starting from each edge of a longer side of said C shaped cross section;

b) right side and left side post connector plates; each of said right side and said left side post connector plates having projection means that slidably fit into a minimum of two of said multiple evenly spaced downward slanted openings in said C shaped posts with said projection means being so shaped that downward pressure on said post connector plates causes said Post connector plates to pull more tightly to said posts; and c) multiple extensible rail means and multiple hinge connector means; said hinge connector means being pivotally fastenable on a single side to said post connector plates and being pivotally fastenable on a dual side to an end of said extensible rail means; said extensible rail means having a first rail that slidably fits within a second rail; and d) a fastening means to rigidly fasten together said first rail and said second rail at a desired effective length.

7. A multipurpose reusable rail assembly as in claim 6 wherein said fastening means to fasten said first rail to said second rail is a pin that fits through openings in said rails.

8. A multipurpose reusable rail assembly comprising:

a) multiple posts with a C shaped cross section, said posts having multiple evenly spaced downward slanted openings along each edge of a longer side of said C shaped cross section;

b) a rectangular post connector and a baseplate, said post connector being connected on one end to said baseplate and being sized to closely and slidably fit into an end of said C shaped post; said baseplate having multiple openings to allow rigidly fastening said baseplate to a surface;

c) right side and left side post connector plates; each of said right side and said left side post connector plates having projection means that slidably fit into a minimum of two of said multiple evenly spaced downward slanted openings in said C shaped posts with said projection means being so shaped that downward pressure on said post connector plates causes said post connector plates to pull more tightly to said posts; and d) multiple extensible rail means and multiple hinge connector means; said hinge connector means being pivotally fastenable on a single side to said post connector plate and being pivotally fastenable on a dual side to an end of said extensible rail means; said extensible rail means having a first rail that slidably fits within a second rail;

e) a fastening means to rigidly fasten together said first rail and said second rail at a desired effective length.

* * * * *